US008590201B2

(12) United States Patent
Brixius

(10) Patent No.: US 8,590,201 B2
(45) Date of Patent: Nov. 26, 2013

(54) FIREARM GRIP

(75) Inventor: John Brixius, Mount Vernon, NY (US)

(73) Assignee: Grauer Systems, LLC, New York, NY (US)

( * ) Notice: Subject to any disclaimer, the term of this patent is extended or adjusted under 35 U.S.C. 154(b) by 309 days.

(21) Appl. No.: 13/054,822

(22) PCT Filed: Jul. 15, 2009

(86) PCT No.: PCT/US2009/050673

§ 371 (c)(1), (2), (4) Date: Apr. 14, 2011

(87) PCT Pub. No.: WO2010/042262

PCT Pub. Date: Apr. 15, 2010

(65) Prior Publication Data

US 2011/0185617 A1 Aug. 4, 2011

Related U.S. Application Data

(60) Provisional application No. 61/144,557, filed on Jan. 14, 2009, provisional application No. 61/082,290, filed on Jul. 21, 2008.

(51) Int. Cl.
*F41C 23/16* (2006.01)

(52) U.S. Cl.
USPC ..... 42/71.01; 89/1.42

(58) Field of Classification Search
USPC ..... 42/71.01, 72, 49.02, 90, 73, 85, 6; 89/1.42
See application file for complete search history.

(56) References Cited

U.S. PATENT DOCUMENTS 7,243,454 B1 * 7/2007 Cahill ..... 42/72
7,823,312 B2 * 11/2010 Faifer ..... 42/49.02

* cited by examiner

*Primary Examiner* — Michael Carone
*Assistant Examiner* — Reginald Tillman, Jr.
(74) *Attorney, Agent, or Firm* — RatnerPrestia

(57) ABSTRACT

An integrated grip and rail system is provided. Included is a firearm and the firearm grip. The grip is configured to be disposed in front of the magazine well and provide a stable grip point which does not allow a user's thumb or other appendage to be disposed between the grip and magazine well. The grip is configured so as to not interfere with the pivoting relationship between the weapon upper and weapon lower during partial or complete disassembly of the weapon. The rear region may also have a portion extending rearward along at least part of each side of the magazine well to form feed ramps as a part of the magazine well extension. Included is a magazine well extension mechanically coupled to a fore-arm rail system for mounting to the firearm.

20 Claims, 22 Drawing Sheets

FIREARM GRIP

CROSS REFERENCE TO RELATED APPLICATIONS

This application claims the benefit of earlier filed International Application PCT/US2009/050673 filed Jul. 15, 2009 which claimed priority of U.S. Provisional Patent Applications 61/082,290 filed Jul. 21, 2008 and 61/144,557 file Jan. 14, 2009, of all which are hereby incorporated herein in their entireties.

FIELD OF INVENTION

The present invention relates to firearms, and more specifically to firearm grips and how their design affects the performance of the firearm.

BACKGROUND OF INVENTION

Since the 13$^{th}$ century, firearms have operated on the principle that an explosive mass of powder, generally referred to as gun powder, could be ignited and caused to react and rapidly expand, causing a sudden increase in pressure within a confined and defined space. This initially constant volume pressure increase was caused to happen behind a projectile, which was then forced in the one direction it could move, along with the reacting gas, which was down a barrel and out the end of a firearm muzzle. Early firearms were loaded down the muzzle, by first inserting a charge of gunpowder, and then on top of that powder adding a projectile, which was typically a lead ball, and pushing the ball down the muzzle with a ram-rod to seat the ball atop the powder charge. These, of course, were known as muzzleloaders.

As firearm technology progressed, primarily in the United States during the 1850's and 1860's, it became possible to load a charge of powder into a casing, or shell, and seat the projectile in a friction fit at the open end of the casing. This discovery led to the development of a whole new era in firearm development. Christopher Spencer received patent protection on Mar. 6, 1860 (U.S. Pat. No. 27,393) for what became known as the Spencer Repeating Rifle. Tyler Henry received a patent for the Henry Rifle on Oct. 16, 1860 (U.S. Pat. No. 30,446), and Horace Smith and Daniel Wesson eventually formed Smith & Wesson to manufacture some of the first revolvers using these new cartridges, and thereby continued firearm development which led to the issuance of numerous patents for innovation during this time period. Of course, Colt's Patent Arms Manufacturing Company received a large number of patents over the years, perhaps most notably for its Colt's Single Action Army Revolver which utilized these new cartridges in what is now a famous revolving cylinder repeater.

All of these developments in firearm and cartridge technology paved the path from muzzleloaders to the modern cartridge, which, even today, is typically comprised of a metal casing (originally copper and now often brass), with a primer lodged in one end and the bullet (projectile) lodged in the other. Contained within the casing is the gunpowder. The primer does not come out of the casing during the firing of the cartridge. The cartridge is loaded into a modern firearm in a number of different ways depending upon the particular action of the firearm used. The common link between the many modern actions, however, is that they are loaded at their breech, instead of down the muzzle as was traditionally done.

In these more modern firearms, when the firing pin of the firearm strikes the cartridge's primer, the primer ignites the powder within the shell, causing an extremely rapid pressure increase, which causes the projectile to dislodge from the shell's open end, driving the projectile down the barrel of the firearm and out the end of the muzzle toward its target. The explosion is an extremely fast exothermic chemical reaction that occurs in a constant volume as the contents of the gunpowder react. This constant volume expansion causes both a pressure increase and a concomitant temperature increase within the system. It is the large and extremely rapid pressure increase during the chemical reaction of the powder that generates the force necessary to drive the projectile at a high speed down the barrel.

Many modern loads have been developed to generate bullet energies over 3,000 ft-lbs at the muzzle and bullet velocities over 3000 ft/sec at the muzzle. For example, a typical 150 grain .30-06 bullet will have a muzzle velocity of about 2900 ft/sec and hold nearly 2900 ft-lbs. of energy at the muzzle. This level of energy requires powders and loads that generate great temperatures and pressures within the barrel. As the high temperature gases follow the bullet down the bore of the barrel, the temperature of the barrel raises significantly. This is especially profound when rapid-fire rifles are involved because the barrel does not have time to cool between shots.

Also an issue is the high recoil of the high-pressure, heavy bullet systems common today. Recoil is essentially defined as what the shooter experiences as he holds the firearm, often to his shoulder, and always at least in his hand or hands, as the firearm discharges. For every action, there is an equal and opposite reaction. If a 200 grain bullet leaves a muzzle with over 3000 ft-lbs of energy, that momentum is also applied through the firearm to the shooter holding the firearm. These great recoils are not only sometimes uncomfortable or even damaging to the shooter, but greatly affect accuracy, target reacquisition, and sight realignment between shots.

Recoil and firearm control is especially an issue in tactical close quarter combat (CQC) or close quarter battle (CQB) situations, such as is very typical in urban warfare settings or in police or SWAT operations. Urban combat is very different from combat in the open at both the operational and tactical levels. Tactics are complicated by a three-dimensional environment, limited fields of view, and fire because of buildings, enhanced concealment and cover for enemy forces or criminals, below-ground infrastructure, and the ease of placement of traps and snipers.

The term close quarter battle refers to fighting methods within buildings, streets, narrow alleys and other places where visibility and maneuverability are limited. The primary purpose of CQB tactics concerns the safe and effective movement of a small squad of infantry troops or police officers fighting or operating in urban environments and/or inside a building. Although it should be noted that military CQB doctrine is different from police CQB doctrine (mainly because the military usually operates in hostile areas while the police operates within friendly populations), at least one factor is consistent. That factor is that each serviceman, soldier, Marine, officer or SWAT team member needs to move quickly, freely, and strategically, while keeping his body protected and drawn in as much as possible to reduce the potential target area for an enemy or criminal to do harm.

SUMMARY OF INVENTION

The present invention provides an advantage to police officers, servicepersons, and responsible civilians who use a style of rifle which includes a forward magazine well such as is present on those commonly known as M16 or AR-15 style rifles. These would include variations of these including at least the AR15, M16A1, M16A2, M16A3, M16A4, M4, M4A1, H&K 416, FN SCAR, and XM8 rifles.

Included in the present invention is a grip for a weapon having a weapon upper, a weapon lower, and a forward magazine well, where the weapon upper and weapon lower are engageable in a pivoting relationship. The grip comprises a portion adapted to extend generally downward along at least a part of the front of the magazine well so as to prevent the insertion of any part of the hand of the user between the grip and the front of the magazine well. The grip is configured so as to not interfere with the pivoting relationship between the weapon upper and weapon lower during partial or complete disassembly of the weapon. The grip may be removable, partially removable, or adjustable in such a way as to allow relative movement between the upper and lower. In one embodiment, the grip is adapted to mechanically couple to the weapon in a first position compatible with the weapon upper and weapon lower being engaged in a firing position, and to move to a second position compatible with pivoting the weapon upper and weapon lower to a non-firing position sufficient to allow access to the breach.

One embodiment of the present invention in accordance with the above is a grip having connection means for removably connecting the grip to the weapon, and a rear region configured to extend generally downward along at least a part of the front of the magazine well when the grip is attached to the weapon. The rear region is configured to be sufficiently close to the magazine well to prevent the insertion of a part of the hand of the user between the grip and the front of the magazine well. One advantage to this configuration is that the user's hand cannot directly grasp the well or the magazine.

The present invention also includes a grip for a rifle or weapon which has a forward magazine well, the grip comprising a forward region having connection means for removably connecting the grip to the rifle forearm, and a rear region extending generally downward along at least a part of the front of the magazine well, and having a portion extending rearward along at least part of each side of the magazine well. A preferred embodiment in accordance with this featured includes the rear region further comprising an angled feed ramp surface, to aide in magazine insertion into the magazine well.

The present invention also includes a grip for a rifle which has a forward magazine well, the grip comprising a forward region having a rail connection point for removably connecting the grip to the rifle forearm, and a rear region extending generally downward along at least a part of the front of the magazine well, and having a portion extending rearward along at least part of each side of the magazine well.

In a preferred embodiment, the grip also includes an internal cavity for the storage of batteries and/or instrumentation.

The present invention includes a weapon or rifle having a forearm in front of a forward magazine well, the weapon or rifle including a grip having a portion of the grip extending generally downward along at least a part of the front of the magazine well so as to prevent the insertion of any part of the hand of the user between the grip and the front of the magazine well. In a preferred embodiment, the grip is configured so as to not interfere with the pivoting relationship between the weapon upper and weapon lower during partial or complete disassembly of the weapon. In one embodiment, the grip is adapted to mechanically couple to the weapon in a first position compatible with a firing position, and to move to a second position compatible with pivoting the weapon upper and weapon lower to a non-firing position.

The present invention also includes a rifle or weapon having a forearm in front of a forward magazine well, the rifle or weapon comprising a grip having a forward region and a rear region. The forward region extends along at least a part of the forearm. The rear region has means for removably attaching the grip to the forearm at a location in front of the magazine well. The rear region also extends generally downward so as to be disposed, when mounted on the rifle, along at least a part of the front of the magazine well, the rear region also having a portion which extends rearward from the downward region so as to be disposed, when mounted on the rifle, along at least part of each side of the magazine well to form an angled feed ramp on each side of the magazine well to aide in magazine insertion into the magazine well.

In another embodiment, the invention includes an integrated rail system, or handguard (also known as a forend) along with the grip.

BRIEF DESCRIPTION OF THE FIGURES

The features of the invention believed to be novel and the elements characteristic of the invention are set forth with particularity in the appended claims. The figures are for illustration purposes only and are not necessarily drawn to scale. The invention itself, however, both as to organization and method of operation, may best be understood by reference to the detailed description which follows taken in conjunction with the accompanying drawings in which:

DETAILED DESCRIPTION OF THE INVENTION

Figure 1:
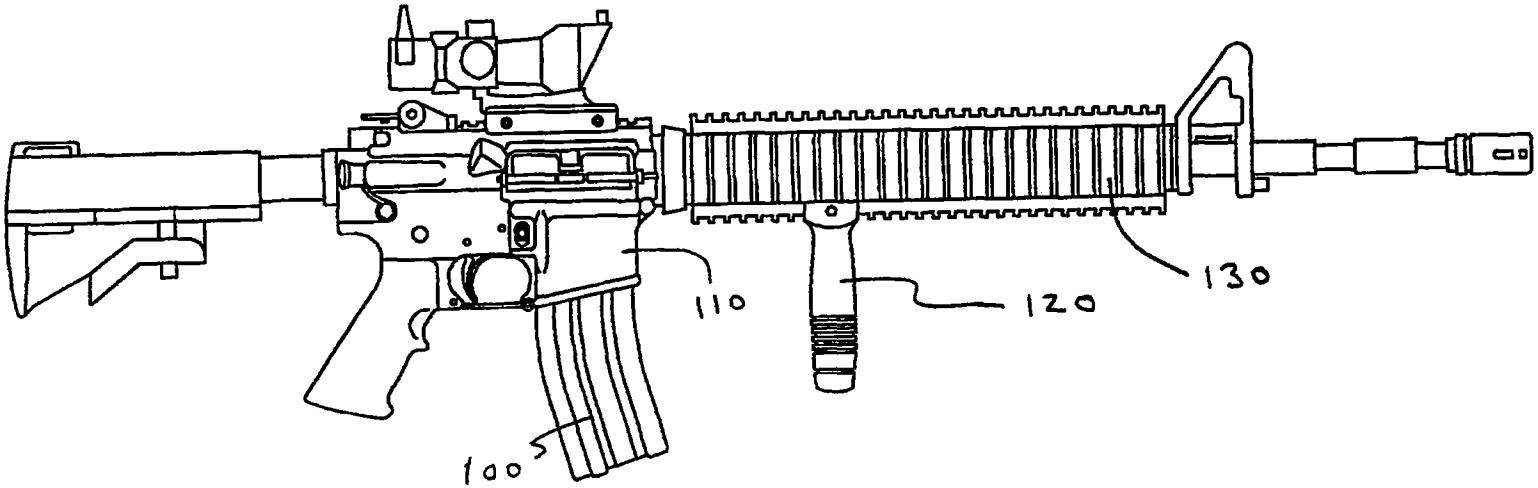
Fig. 1 (Prior Art)
FIG. 1 illustrates a prior art rifle.

The present invention includes several features to improve firearm performance and allow a user of the firearm to achieve a stable, controlled grip on the firearm while also maintaining a minimized silhouette. It includes a grip assembly having a portion adapted to extend generally downward along at least a part of the front of the magazine well so as to prevent the insertion of any part of the hand of the user between the grip and the front of the magazine well. The grip is configured so as to not interfere with the pivoting relationship between the weapon upper and weapon lower during partial or complete disassembly of the weapon. The grip may be removable, partially removable, or adjustable in such a way as to allow relative movement between the upper and lower. The present invention is applicable to any style of rifle which includes a forward magazine well such as is present on those commonly known as M16 or AR15 style rifles, including variants such as H&K 416, FN SCAR, and XM8 rifles. In one embodiment, the grip easily attaches to the rifle or weapon and can be added to existing weapons as an aftermarket part, or manufactured as an OEM part to a new rifle or weapon system.

A preferred embodiment of the present invention includes an integrated grip and forearm rail system. In such a case, the forearm rail is attached to the rifle in a standard manner and the grip is then moved into place around the magazine well to provide not only the grip point in front of the magazine well but also the feed ramps as will be addressed in more detail below. A further feature of a preferred embodiment includes a storage compartment (such as for housing a power supply) in the grip's forward region. This aspect will also be addressed in more detail below.

For purposes of this disclosure, the term, "rifle" and "weapon" will mean any weapon which has a detachable magazine which is inserted into a magazine well in front of the trigger. Typical of these rifles are those chambered in .223 caliber, 5.56×45 mm, 7.62×39 mm, or .308 caliber. These rifles include a number of variants, including at least the AR15, M16A1, M16A2, M16A3, M16A4, M4, M4A1, H&K 416, FN SCAR, and XM8 rifles. The XM8 is a derivative of the Heckler-Koch G36 assault rifle, which would also be included in this definition. By "forward magazine well" it is meant that the magazine well is disposed in front of the trigger.

Unless otherwise noted herein, the terms "distal" and "forward" and "fore" and "front" all refer to a relative position away from a shooter in the direction of a projectile being fired, and the terms "proximal" and "rearward" and "rear" and "back" all refer to a relative position closer to the shooter with respect to the direction of a projectile being fired. The terms, "downward" and "upward" refer to a relative position with respect to the ground when the rifle is up in a shooting position generally parallel to the ground.

As noted above in the background, during CQB or CQC situations, an operator desires to maneuver in a physically "drawn in" condition to minimize his exposure. This is particularly dramatized by an instinctive shooting position, the "magazine hold", very commonly used by warfighters who carry the M16/M4 service rifle and other similar types of weapons, or other such weapons having a forward magazine well configuration. As one example, note the popular use of SMGs (sub machine guns) such as the MP5, which generally highlight the desire for a "drawn in" condition.

The M16/M4 service rifle is one common example of a weapon having a forward magazine well configuration. In such weapons, the area where ammunition is stored in the weapon—the magazine—is located immediately forward of the trigger guard. If the magazine is detachable, it fits into the weapon through a magazine well. From this position, the cycling action of the weapon strips the top cartridge from the magazine and feeds it forward into the chamber, which is located just forward of the magazine well. This configuration of the magazine and magazine well being forward of the trigger guard, is the "forward magazine well" configuration.

An alternative to the forward magazine well configuration is the bull pup configuration. With this design, the magazine and chamber are located behind the trigger and pistol grip of the shooting hand. Typically in the bull pup design, the magazine well, and hence magazine, are housed in the butt stock of the weapon. This configuration is not commonly used, and the vast majority of shoulder fired weapon systems utilize the forward magazine well configuration.

Warfighters are trained to use their non-shooting hand to grasp the weapon at a forward location to improve the control and stability of the weapon. For both the forward magazine well and bull pup configurations, the forend grip is the designated location to facilitate this. The forend grip may be of different orientations, such as horizontal or vertical, but the location is one aspect that is consistently the same—it is located along the barrel, forward of the chamber and forward of the trigger guard and the shooting hand. For the forward magazine well configuration, this location is traditionally designed to be distal of the forward magazine well.

Despite the fact that warfighters are trained to grasp the fore-end grip with their non-shooting hand, in real combat situations many warfighters instinctively pull back and grasp the forward area of the magazine well and forward area of the exposed magazine when using a weapon of the forward magazine well configuration, such as the M16/M4. This phenomena is shown, for example, in FIG. 2. Warfighters gravitate toward this position despite being trained not to do so. The reason it is not preferred is two-fold. First, such a hold places the two hands too close together to give the warfighter adequate control of the weapon. Essentially, the non-shooting hand is too far rearward to adequately control the weapon. Where the two hands are used to stabilize the weapon, the separation of the hands is important for adequate control. Alternatively, where the shooter has the weapon's butt stock firmly tucked against his shoulder, the shooting hand is not primarily (or even at all) used to control the weapon positioning. In this later instance, it is not the distance between the hands that creates the control. Rather it is how much weight lies in front of the non-shooting hand. In this case, the grip of the present invention provides a suitable and improved position.

The second problem is that by grasping the magazine, the user can cause the magazine to move slightly within the magazine well, which will alter the respective alignment of the two, and may adversely affect the reliability of the cycling mechanism.

Despite these problems, there are reasons why warfighters gravitate toward this shooting position which seem to, in total, outweigh the negative aspects of using this hold. First, this position is a more natural, comfortable and efficient position for the warfighter's hand and arm. As mentioned previously, in real combat, warfighters tend to draw their bodies in and the magazine hold is an example of this condition—it is a more natural and instinctive position.

Second, it is more efficient in that by having the arm less extended outward and the upper arm at a lower angle, there is less torque for the warfighter's non-shooting shoulder to support. The warfighter can hold his arm steady in this position for longer periods of time.

Third, it has been shown that a vertical orientation of the hand is more ergonomical than a horizontal position, and the magazine hold provides such an orientation.

Fourth, because the thumb of the forehand does not wrap around the rear of any portion of the magazine well, the warfighter can not efficiently exert a forward force on the weapon, and must pull the weapon into him for stability, which is a very stable and efficient way to use the non-shooting hand to achieve weapon stability for a shoulder fired weapon. Additionally, it fits perfectly with the instinctive nature to "draw in" during combat.

Fifth, the sides of the magazine and magazine well form two large geometric planes that are parallel to the direction of the bore. By virtue of the fact that a large portion of the shooter's palm and fingers come into contact with these geometric planes, tactile feedback is provided to the shooter's brain which signals the direction in which the weapon is pointing.

If it were possible for a grip to take into account all the advantages of the magazine hold, while simultaneously improving upon its two major shortcomings of reduced weapon control and causing movement of the magazine within the well, it would be a significant improvement.

FIG. 1 is prior art and illustrates a side view of a standard M4A1 rifle. As can be seen, magazine 100 is shown inserted into magazine well 110. Forward of that is a vertical forearm grip 120 shown mounted to a rail system on the rifle's forend 130. Although popular and reasonably effective at supporting the firearm, vertical forearm grip 120 requires the user to extend his forward hand outward to reach the grip. This may be comfortable for patrol or carry, or even necessary and effective in certain situations, but in some situations, users have instead brought their forearm hand back and placed it against the magazine well 110 to support the firearm but achieve a more compressed upper body position.

Figure 2:
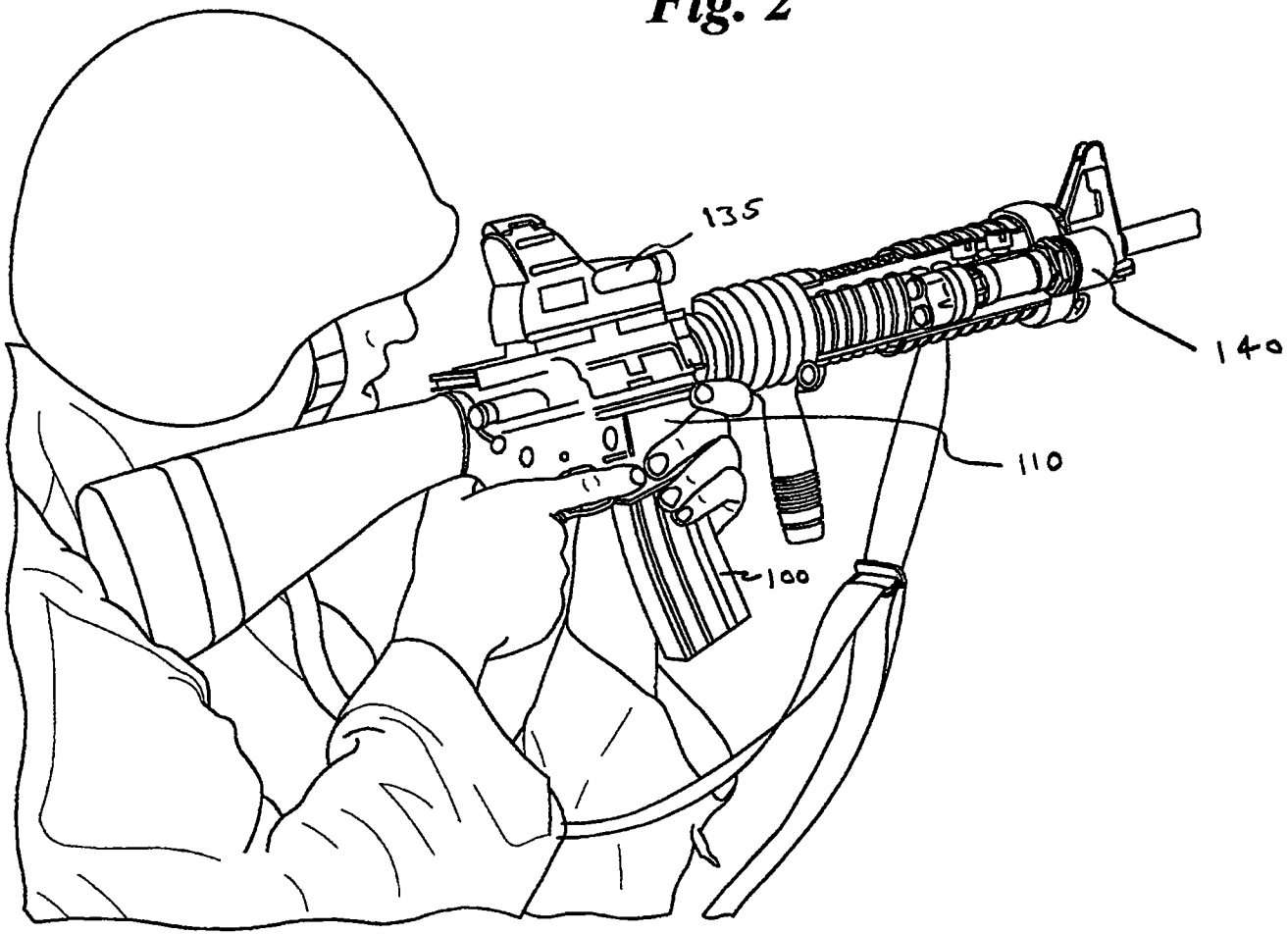
FIG. 2 illustrates a shooter gripping a prior art rifle in a shooting position.

FIG. 2, as noted above, shows a rifle gripped by the user in the way described above, that is to say, by gripping the region in front of the magazine 100 which is inserted in magazine well 110. With this form of carry, the user is able to bring his forward hand back to a more compact position, thereby decreasing exposure of vitals and body parts during an operation or when otherwise needed. This form of shooting, however, necessarily results in the user's hand coming into direct contact with the magazine well and magazine, and is limited to a hand-to-weapon contact point which is based on a relatively thin (or narrow width) portion of the overall rifle. In other words, the width of the magazine well (which is only slightly wider than the magazine itself) is relatively narrow as compared to the width of the weapon system, particularly when the rifle is toped with optics like a sight 135 and other components such as a flashlight 140.

Figure 3:
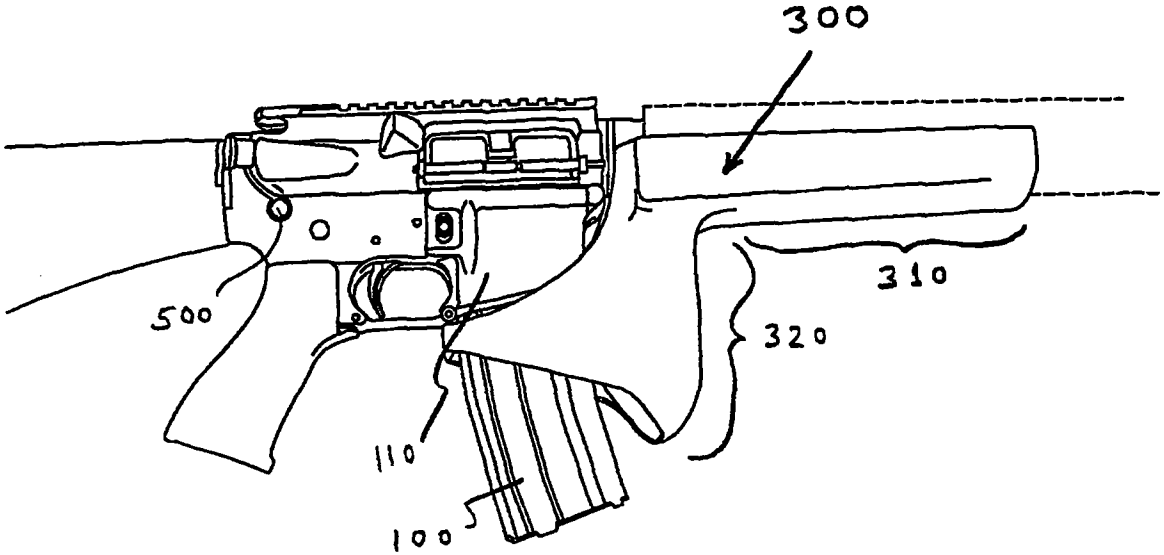
FIG. 3 illustrates an embodiment of the grip of the present invention attached to a rifle with a forward magazine well housing an inserted magazine.
Figure 4:
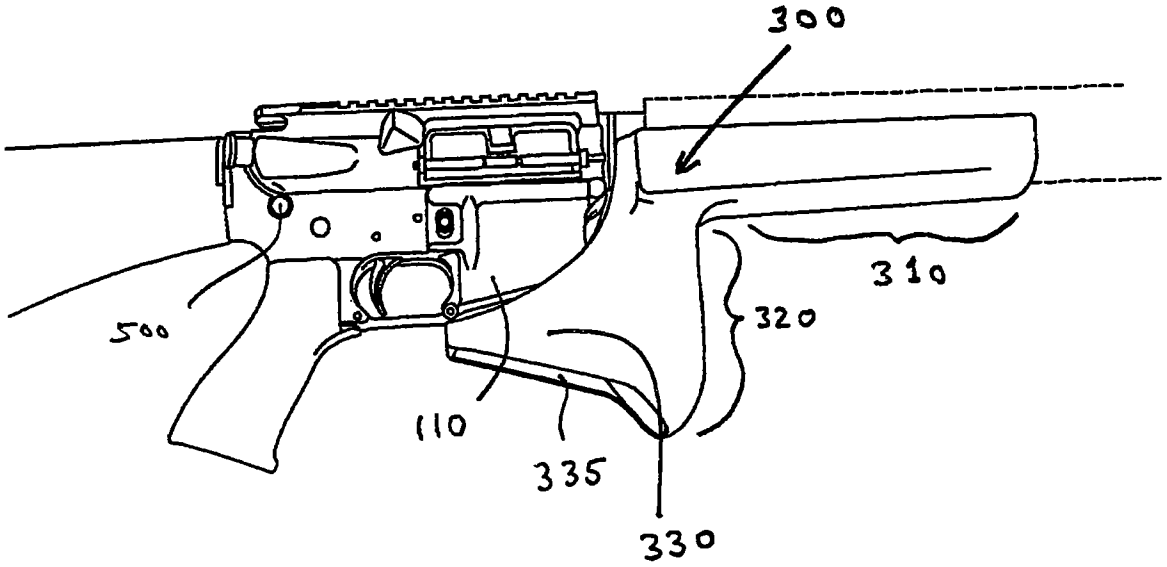
FIG. 4 illustrates that of FIG. 3 but with the magazine removed.

FIG. 3 shows an embodiment of the grip 300 of the present invention in place on a standard M16A4 rifle. As can be seen with this embodiment, grip 300 has a forward, or generally horizontal, region 310 and a rear, generally vertical, region 320 which extends downward from the rifle in front of the magazine 100 and magazine well 110. Rear region 320 is configured to extend generally downward along at least a part of the front of the magazine well (and in this case the magazine itself) when the grip is attached to the weapon. FIG. 4 shows the same embodiment and rifle but with magazine 100 removed. In this embodiment, vertical region 320 further includes rear magazine portion 330 extending generally rearward along at least part of each side of the magazine well 110. A part of the magazine feed ramp is shown in the embodiment, namely feed ramp 335. The feed ramp aspect of this embodiment will be discussed in more detail below.

Figure 3A:
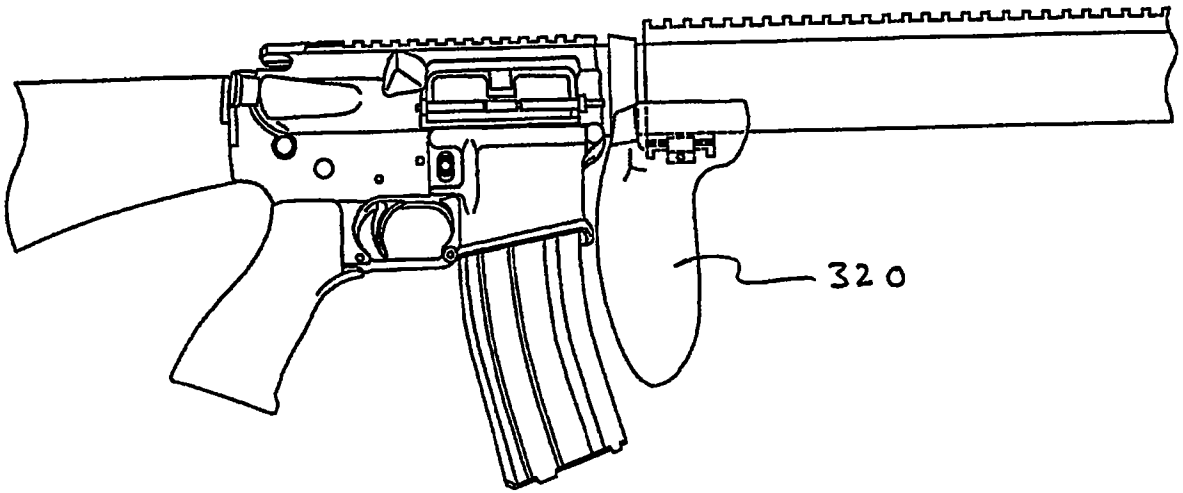
FIG. 3A illustrates an alternative embodiment of the grip of the present invention.

FIG. 3A illustrates an alternative embodiment from that shown in FIG. 3, namely one where vertical region 320 does not include the rear magazine portion 330. This embodiment also shows a grip where there is no horizontal, or forward region 310. The vertical region 320 is sufficient, however, to prevent the insertion of a part of the hand of a user between the grip and the front of the magazine well. It is also noted that although FIG. 3A shows the grip connected to the weapon at the weapon forearm, other points of connection are considered part of one embodiment of the invention.

FIGS. 3 and 3A illustrate several features of the grip in accordance with the present invention. First, the grip provides a larger surface area for the user's forearm hand/forehand to grip (as compared to the grip shown in FIG. 2). The grip also provides a grip point slightly more forward on the rifle as compared that shown in FIG. 2. This achieves several beneficial results as will be addressed below. Another feature shown, in part, is a beveled feed area on the bottom of rear magazine portion 330, which acts as a feed ramp to the magazine well as magazines are loaded. This advantageous feature will also be addressed in more detail below.

One embodiment of the grip, as shown in FIG. 3, has a relatively flat front surface. Other embodiments might include checkering or finger grooves on the front surface.

One skilled in the art of many of these types of rifles, and especially the M16, AR15, and M4 styles, knows that two pins are used to connect the upper to the lower. When the bolt and bolt carrier need to be removed for cleaning, the bore needs to be accessed from the breech, or when any other maintenance requires partial disassembly, the rear receiver pin is pulled out and the front receiver pin is then a pivot point for the upper to be rotated upward to allow access to the bolt and bolt carrier. If the grip of the present invention is not easily moveable, removable, or at least adjustable, to account for this disassembly procedure, it would burden the user in the field. The grip is therefore designed to alleviate any issues with respect to quick rifle takedown or disassembly.

Figure 5:
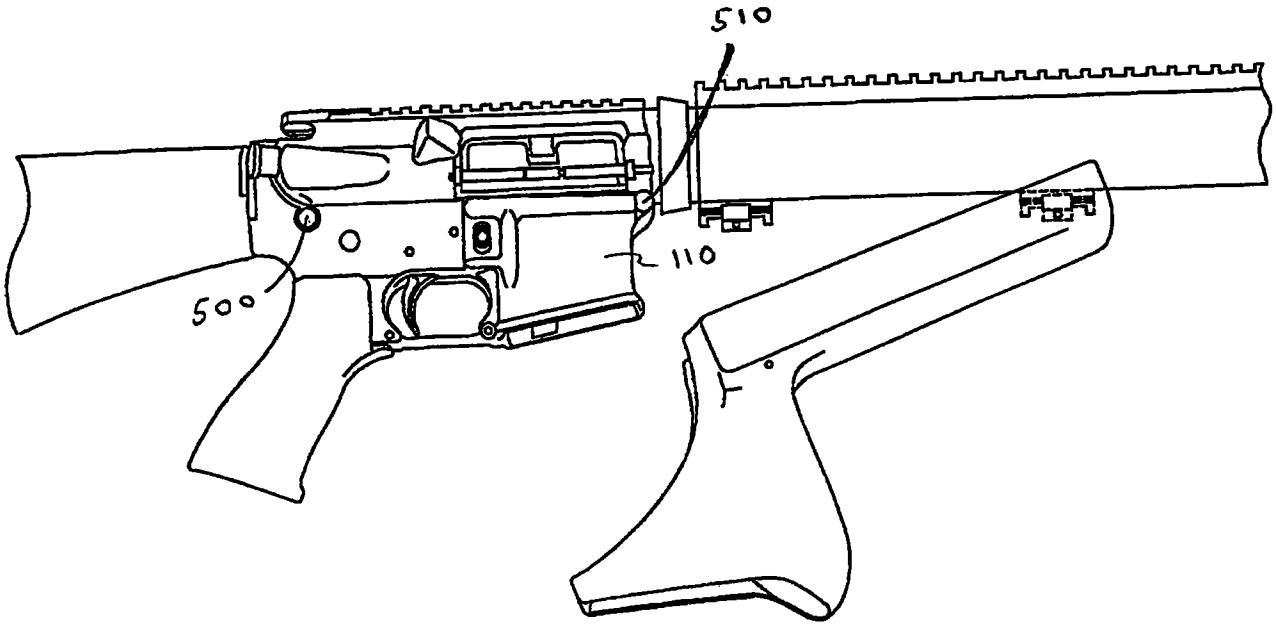
FIG. 5 illustrates the grip of the present invention with the rear portion pivotably lowered from the magazine well.

As shown in FIG. 5, the grip is designed such that it can pivot away from magazine well 110 yet still remain attached at a distal region of the front region. A number of different connection means can be envisioned, including, for example, a pin connection (shown in FIG. 5). Other such connection means would include clips, screws, friction fits, brackets, clamps, plastic ball and socket joints, and hinges.

Figure 6:
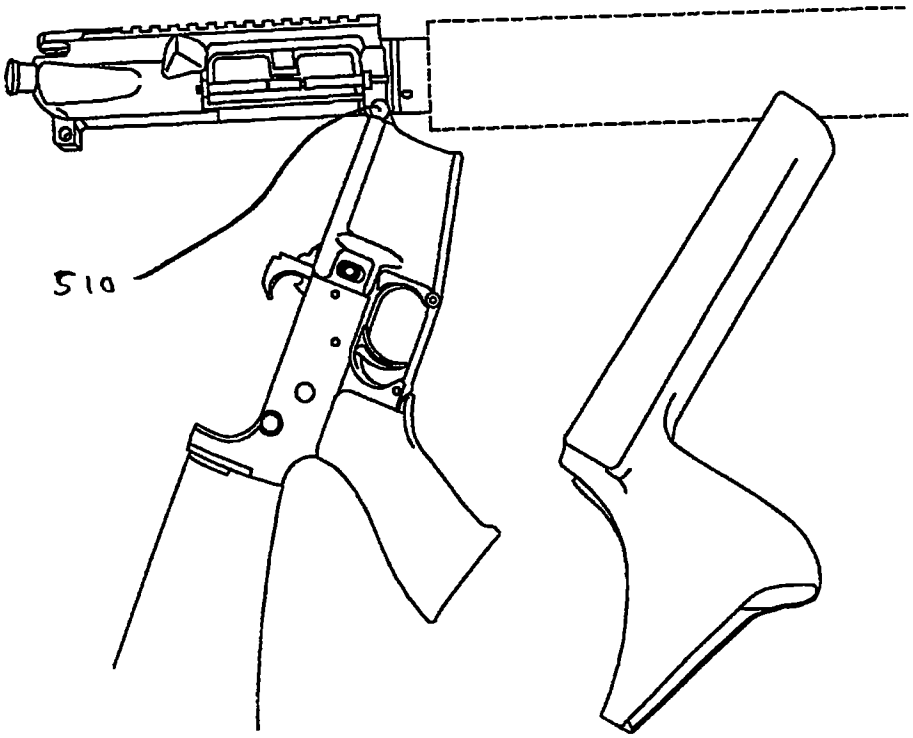
FIG. 6 illustrates the grip of the present invention in its lowered position, still attached at the distal portion to the forearm, with the upper of the rifle opened for bolt removal.

No matter how the grip is connected, once the rear connection point is freed and the grip is rotated away from the magazine well, the rifle is free to open upon withdrawal of firearm rear receiver pin 500. This is shown in FIG. 6. Front receiver pin 510 can remain in place as is typical for standard maintenance. One skilled in the art would know that front receiver pin 510 could be withdrawn as well to completely separate the upper from the lower.

In one embodiment, the forward region of the grip is attached at the forend by a removable pin which allows pivotal movement of the grip around that connection point. When the grip so mounted at its forward region is swung back into place, the rear section of the grip, or the proximal region of the forward region of the grip, is attached to the rifle at the grip's rear connection point by a clip or other removable connection device, such as a friction fit, screw, or second pin. Any connection means which allows easy field removal so as to allow the rear region to swing down out of the way of the magazine well and thereby allow the rifle to be swung into its open position would work. In this manner, the very quick partial adjustability to allow for weapon maintenance is not only convenient, but the fact that the grip is not totally separated from the weapon in this stage yields both simplicity and reliable realignment when it is moved back into its firing position after the rifle is closed. The shooter never needs to be concerned about finding the grip or repositioning it. This is especially convenient where the grip has auxiliaries mounted to it such as a laser sight or flashlight.

Figure 6A:
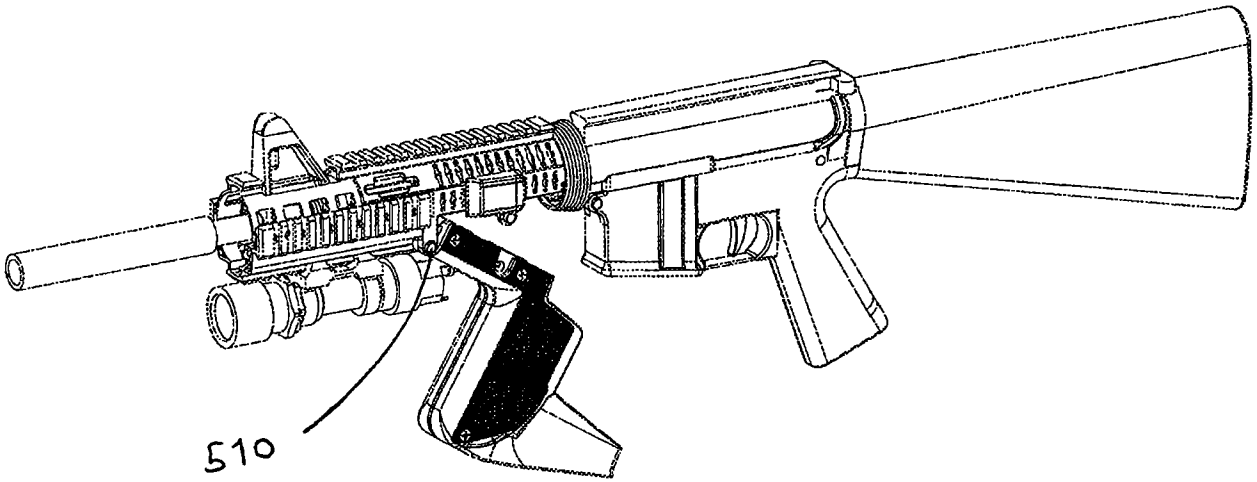
FIG. 6A illustrates an alternative embodiment of the grip shown in FIG. 6, namely where the grip portion is integral with the a forend rail system.

The range of rotation necessary to allow access to the upper receiver as it is swung away from the lower on the forward pin is defined by access to the bolt for a particular firearm or weapon. Typically, in the field, the user only needs the upper receiver to rotate far enough upward with respect to the lower that the rear of the upper clears the lower so that the bolt can be removed. Thus, for a given weapon system, the grip needs to be moveable, pivotable, or otherwise able to be relocated enough so that the upper receiver can at least rotate far enough for the bolt to be removed. Ideally it should be relocated enough so as not to impede the full range of rotation of movement of the upper receiver vis-à-vis the lower. FIG. 6A illustrates that which is described above for the embodiment where the grip is formed integrally with the forearm/forend. Note in this embodiment that the presence of a flashlight mounted to the forend does not interfere with adequate separation of the rear part of the grip from the magazine well. Thus, rifle opening in accordance with that shown and described with respect to FIG. 6 is still achievable.

In addition to the rotational, or pivoting movement described above, other directions of movement can be used to relocate the grip to enable partial or full pivot action of the upper receiver relative to the lower. For example, the grip could be moved forward, distally away from the receiver. This of course would require that the magazine well of the rifle be cleared by the well extension so as to allow for forward movement of the grip. Alternatively, the magazine well extension could be a three-walled funnel with no back wall, and hence there would be no interference with either the lower receiver or an inserted magazine when pulled forward.

The magnitude of the forward displacement would preferably be proportional to the range of pivot movement that would be enabled between the upper and lower receivers. As above, the minimum required movement would be defined by the ability to access the upper and the bolt/bolt carrier, etc.

The types, directions, or magnitudes of movement are not limited to the linear or rotational motions described above. Other movements or combinations of movements, such as both linear and rotational, can be used to achieve the desired state of allowing the upper receiver to pivot partially or fully relative to the lower receiver. So long as the objective of opening/separating the rifle upper and lower to allow access to the bolt carrier is achieved, the movement of the grip with respect to the magazine well can be accomplished in various ways, all within the scope of this aspect of the present invention.

Figure 7:
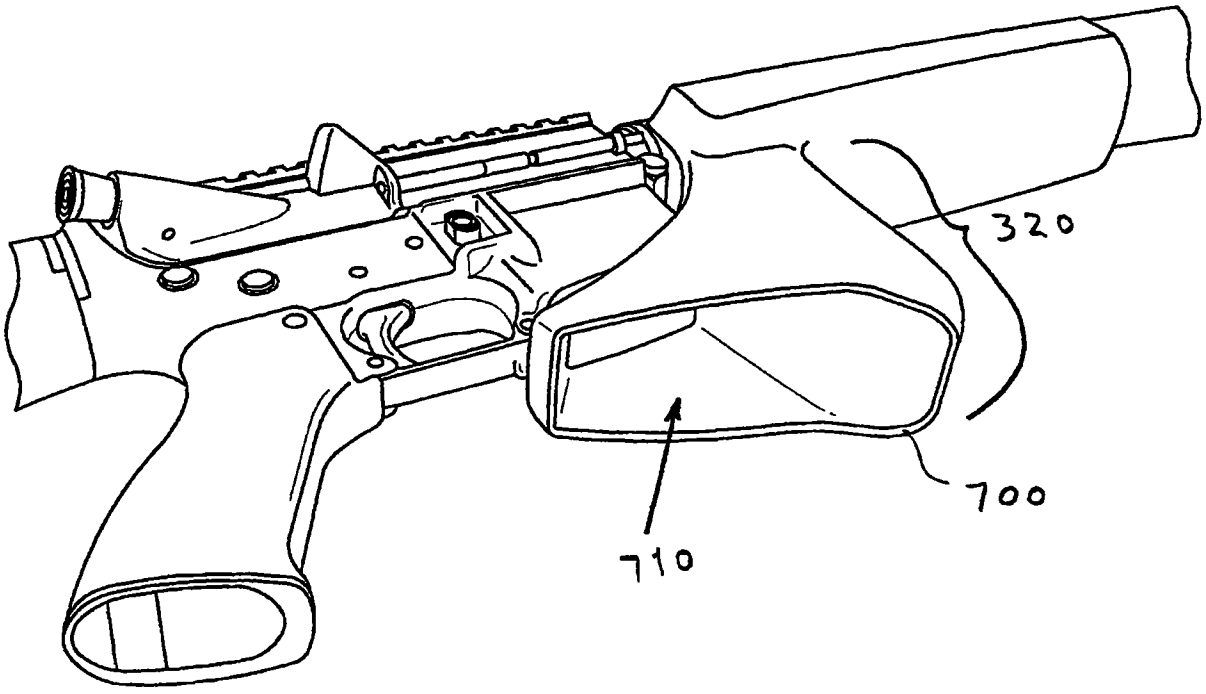
FIG. 7 illustrates a view from the lower portion which shows the beveled magazine well formed by the rear portion of the grip.
Figure 8:
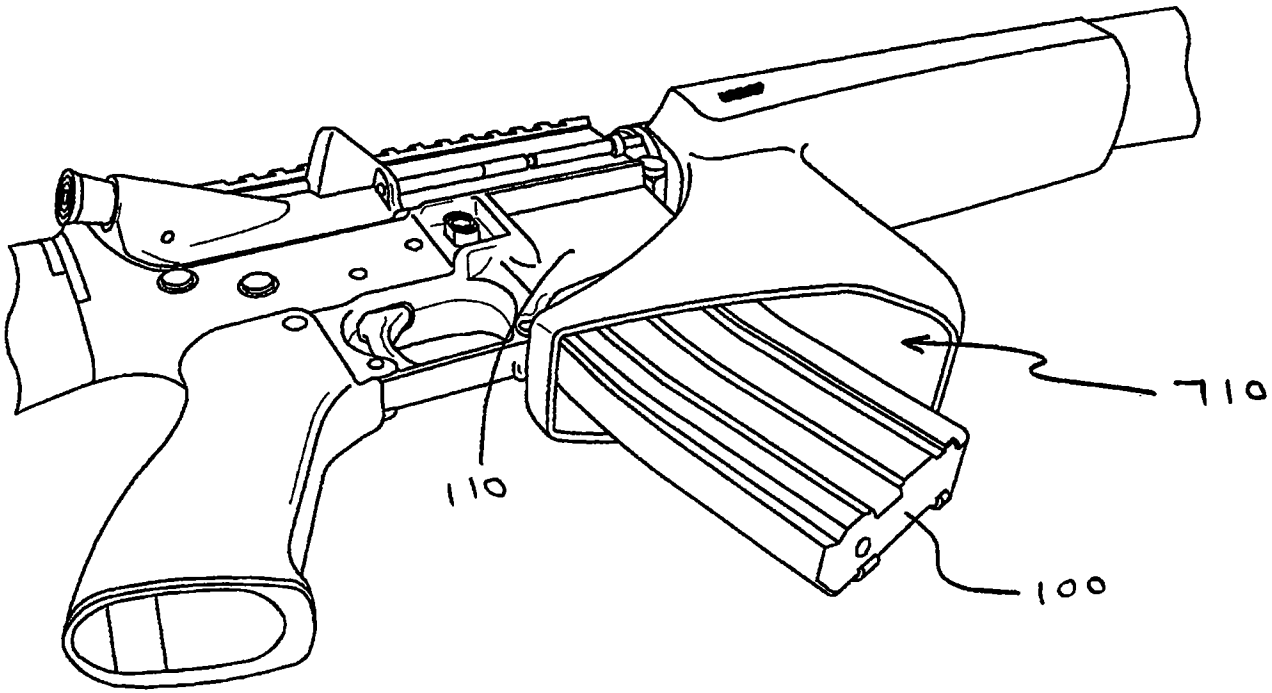
FIG. 8 illustrates that which is shown in FIG. 7 but with a magazine inserted into the magazine well.

Various embodiments of the rear region of the grip can be envisioned within the scope of the present invention. In one embodiment, the rear region can have a rear magazine portion which extends rearward at least part way along each side of the magazine well to form an angled feed ramp surface on each side of the magazine well to aide in magazine insertion into the magazine well. This magazine well extension is shown in FIG. 7. FIG. 7 shows four beveled surfaces which are ramped from the opening edge 700 of feed ramp portion 710 of rear portion 320. This magazine well extension, or ramped feed ramp portion 710, aides in magazine insertion, particularly in high-stress combat reloading scenarios. FIG. 8 illustrates a magazine 100 inserted into magazine well 110 through feed ramp portion 710.

One aspect of having a long flared magazine well is that it allows for both a wide opening and a gradual slope. The wide opening minimizes the possibility that the shooter hits the lip of the funnel with the magazine as he inserts it, and the gradual slope of the funnel guides the magazine into position and orientation without any abrupt movements that could cause the feeding motion to be stopped or disrupted. These benefits, however, are balanced against possible drawbacks of a funneling design that is too large or long, particularly one which is symmetrical. One problem with a large long symmetrical funnel is it is bulky. Another problem is that only a small portion of the magazine (even a 30-round mag) would extend below it, possibly hindering the shooter from feeding it properly if his hand grasps the magazine too high and as a result hits the funnel lip before the magazine is latched into place. In a similar fashion, extraction of the magazine could be hampered if there is too little magazine to grasp. Still another potential problem is that the shorter magazines (like 10 and 20 round mags) are too small to use effectively as their floorplates would actually be disposed above the lip of the funnel when the magazine is latched into the rifle.

A preferred embodiment of the grip in accordance with this invention achieves the advantages described above while avoiding the disadvantages discussed. Being short in the rear as compared to the front (as shown in FIG. 7, for example) allows this embodiment to provide plenty of room for the shooter to grasp the lower portion of the magazine for either insertion or removal. And, by having a portion of the funnel extend downward a relatively long way (the front wall in this embodiment and as shown), it allows for the large opening and gradual slope that aids fast reliable feeding. Thus, as the magazine is brought upward toward the well, the front portion of the magazine engages the lower front portion of the flared funnel which starts the guiding process. By the time the rear portion of the magazine reaches the smaller rear portion of the flared funnel, the vast majority of the alignment process has been completed. Furthermore, the left/right position is complete as is the left/right vertical alignment.

Also, if the shooter brings the magazine into the well at a position that is somewhat forward of where it will enter the weapon, the slope of the front flared funnel wall will guide the magazine to the correct fore/aft location. Thus the only remaining alignment to be done by the time the rear of the magazine reaches the lip of the rear of the funnel is the fore/aft vertical alignment. If the shooter has inserted the magazine in a generally vertical orientation and maintains this orientation as the magazine is moved upward into the funnel, the final fore/aft vertical alignment will result as a result of the slop of the front flared wall causing the magazine to hit the rear wall. Moreover, the particular slopes and dimensions of the funnel/ feed ramp of the grip's magazine well portion can make it very easy to insert a magazine, even in combat situations. Thus, while various slopes and lengths of ramps can be utilized within the scope of this aspect of the present invention, a preferred embodiment has the longest ramp disposed at the front of the well extension.

Figure 10:
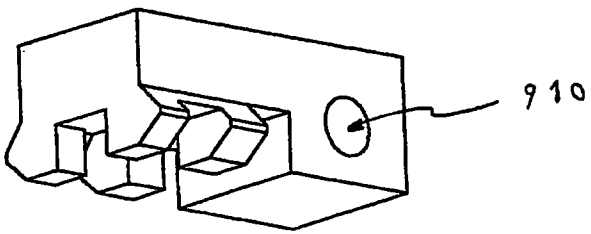
FIG. 10 illustrates an alternative mounting hardware from that shown in FIG. 9.
Figure 9:
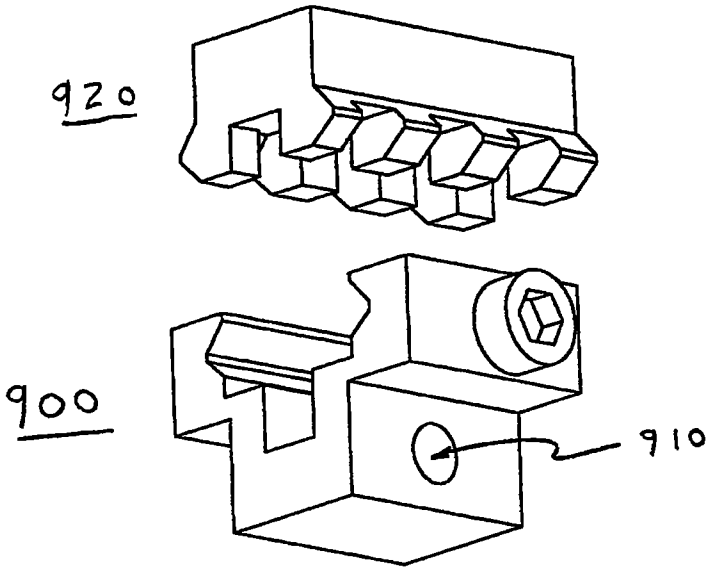
FIG. 9 illustrates one embodiment of the mounting hardware applicable to the present invention.

FIG. 9 shows one embodiment consistent with the above description of various ways to attach a grip in accordance with the present invention. In those instances where a rail mounting system, such as a Picatinny rail, is already present on a rifle, an adapter such as mounting bracket 900 shown in FIG. 9 can be used to mount the grip to the firearm. In the case of the use of mounting bracket 900, and as shown in FIG. 9, the mounting bracket 900 would provide pin hole 910 through which a grip mounting pin could be inserted to thereby attach the grip to the rail. The attachment of mounting bracket 900 to the rail 920 would be done in any of a number of conventional ways. FIG. 9 illustrates a section of Picatinny rail 920 to which mounting bracket 900 would be secured. FIG. 10 illustrates an alternative embodiment wherein the grip pin hole 910 could be formed integrally with a section of rail. In another embodiment, modified rail mounting systems could be envisioned, for example the two pivot pins could be integrated into a piece that attaches to the weapon in a manner similar to one which allows a standard handguard to mount to the weapon. One specific example of this is the Knight rail interface system (RIS), which could be replaced with the grip mount in accordance with the above. (Knight is a trademark of Knight's Armament Company for semiautomatic weapons and related components). Moreover, any appropriate rail mounting system or replacement of a rail mounting system could be integrated with the grip of the present invention. Preferably, it would be compatible with on of the two most common systems, which are the RIS and rail adapter system (RAS). Both of these units use MIL-STD-1913 and MIL-STD-1913 Update Notice 1 Picattinny rails incorporated into variant forend rail assemblies to replace the factory handguards of the host SR-15(AR-15), M-16, and SR-25 weapon systems and provide attachment means for various auxiliaries such as bipods, flashlights, lasers, etc.

Figure 21:
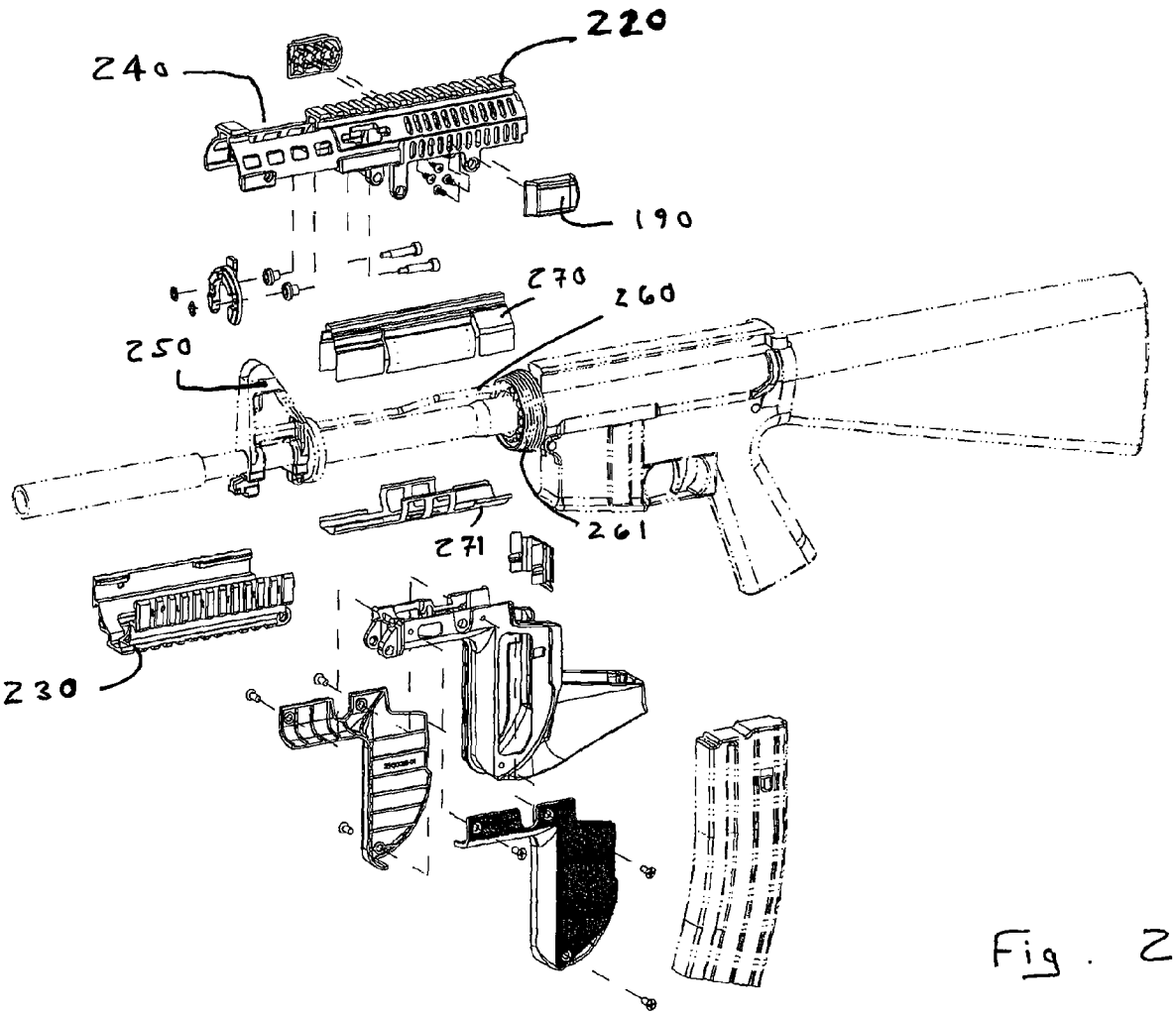
FIG. 21 illustrates an exploded view of an embodiment of the present invention along with a standard M-16 style weapon.

In terms of the RIS, the standard lower component of the RIS can be replaced with a custom unit that internally contains the pivot pin mounting brackets. Likewise, such a component need not be part of the RIS but might also replace the standard lower handguard of a rifle without a rail system. In one embodiment of the present invention, both the upper and lower rails are replaced. The lower is replaced with the grip portion unit, and the upper is replaced with a unit that has holes for the pins. This aspect is discussed more below and is shown in FIG. 21.

It should be noted that any of a number of conventional mounting hardwares could be used to mount the grip at a connection point along the forearm. For example, the rear grip mount could include, instead of a pin, a simple clip around a rail projection such that the user could pinch, between his thumb and forefinger, either side of a clip and release the rear grip mount to allow it to swing away in accordance with that described above with respect to FIGS. 5 and 6. The key to at least this aspect of the invention is that the grip be easily released from the rear attachment point for purposes of action opening, and that it be ultimately be completely removable for maintenance, replacement, etc.

Figure 11:
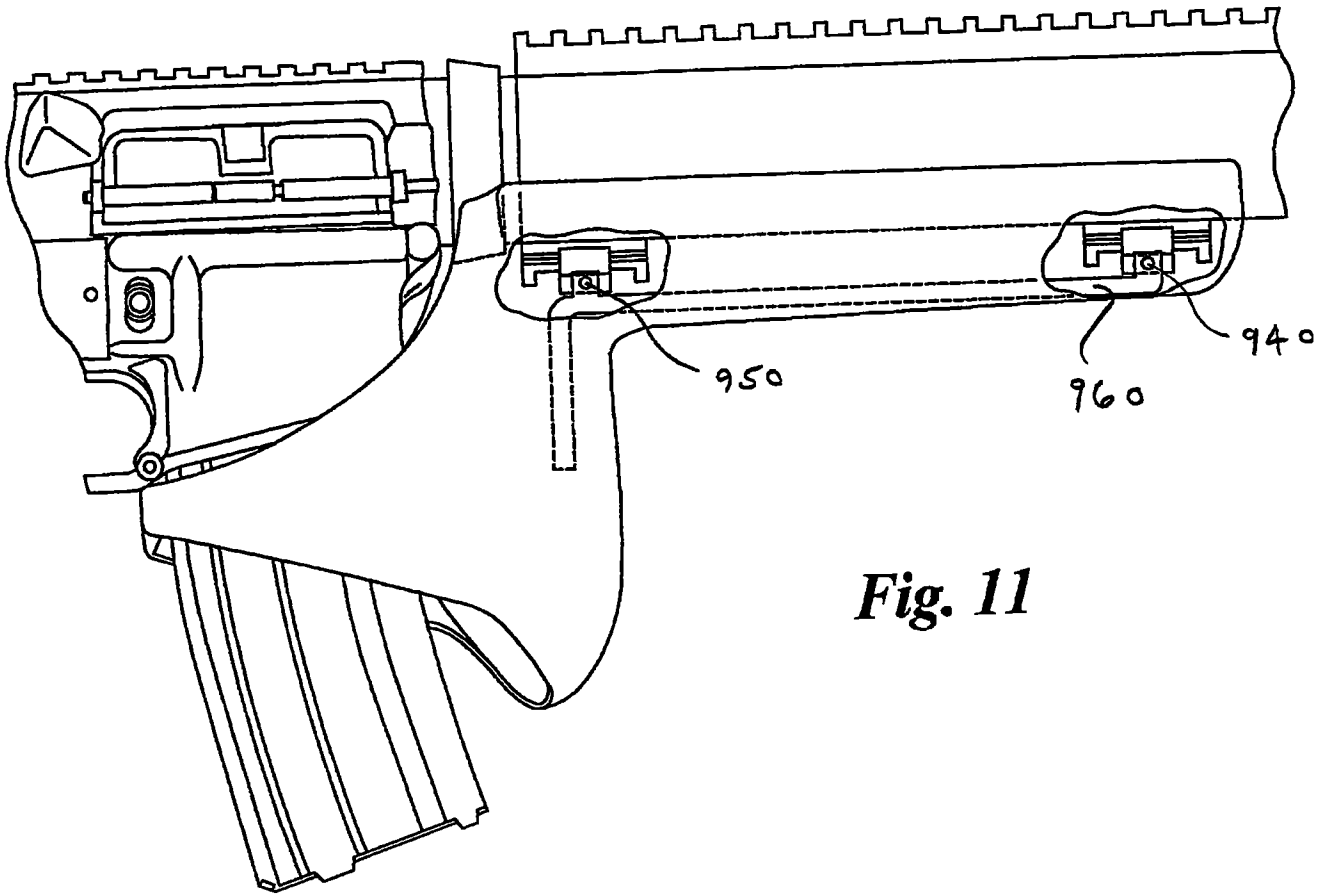
FIG. 11 illustrates an embodiment of the present invention with an internal frame mounted to the mounting points on the rifle, where the grip has been integrally formed around the frame.

FIG. 11 shows the grip mounted to the mounting bracket 900 on a firearm in accordance with the hardware shown in FIGS. 9 and 10. As shown in FIG. 11, pivot pin 940 and rear grip pin 950 would provide releaseably attached anchor points for the grip mount. Also shown is a frame 960, which forms something of a skeleton for the grip body. In a preferred embodiment, the grip body is formed of a durable polymer or composite, and the frame 960 is formed of a metal or suitably rigid material (carbon fiber, etc.) to provide a rigidity and strength to the grip. In any event, the grip body and internal frame 960 would be joined together for necessary strength. In one embodiment, the grip body would be molded around the frame during manufacture.

One advantage of the grip of the present invention over that of the grip shown in FIG. 1, relates to the physics involved with the firing of the rifle. When the user grips the vertical forend grip shown in FIG. 1, he will wrap his hand around the grip, with at least a portion of his hand (typically his thumb) extending around the back. As the rifle is fired, the grip will move rearward and upward. The thumb is then used to absorb this recoil, and a force will be applied to the back of the vertical forend grip to move the rifle back down to a firing position. In so doing, the user will tend to naturally extend the rifle muzzle in a direction different from the original firing position and the hand will have to re-stabilize the rifle muzzle at each shot, continuously balancing the forward-applied forces applied by the thumb at the rear of the vertical forend grip with the rearward-applied forces applied by the remainder of the hand (typically the four fingers which extend around the front and to the side of the vertical forend grip). This balancing of forces in various directions tends to destabilize the rifle as the user reacts to the recoil of a shot and re-centers the sights on a target during target reacquisition. It also tends to pull the rifle from the user's shoulder as forces are applied in reaction to the recoil of the shot. The user must then pull the firearm back to the shoulder to stabilize the rifle for the next shot.

The grip of the present invention solves this problem, however, in that it provides a surface for the entire fore hand to grip the rifle with no surface area facing the rear for any part of the hand to contact. This means that after a shot, the user is simply pulling the rifle in one direction, toward and into the shoulder, without competing forward forces being applied to the grip. Moreover, the weapon is maintained against the shoulder of the shooter more easily when forward applied forces are not involved. Stability of the weapon during and after a shot is improved as compared to the vertical forend grip of the prior art.

Figure 12:
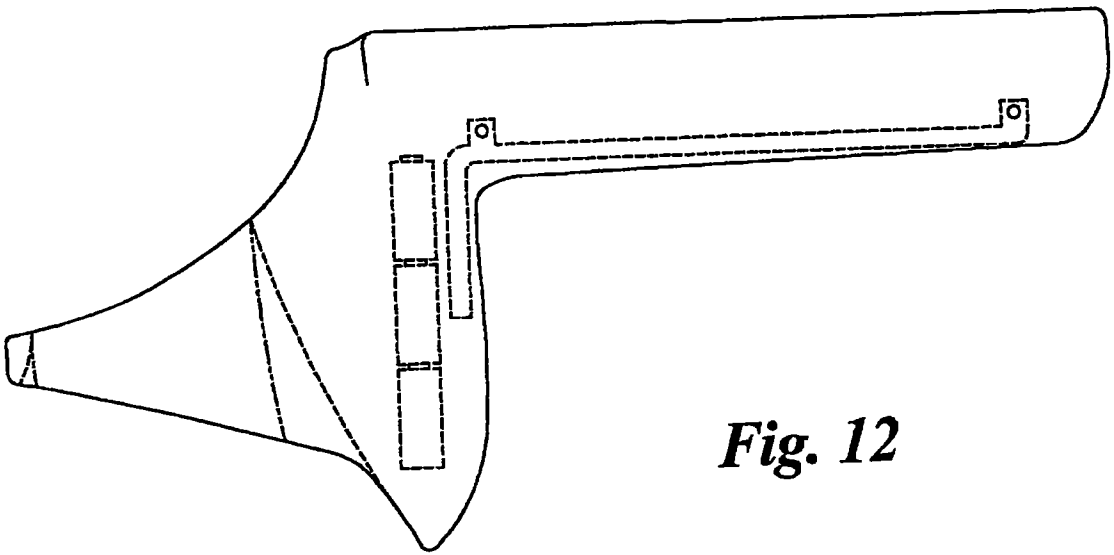
FIG. 12 diagrammatically illustrates an embodiment of the invention where the grip includes a storage compartment for batteries.

In still yet another embodiment of the present invention, the grip is configured to provide an internal cavity, such as for internal storage, preferably in its front wall. A preferred such embodiment would include the storage of batteries to supply power to auxiliary devices such as laser sights, flashlights, sight optics such as red-dot sights, or night-vision scopes. These devices draw a large amount of energy and the ability to safely store batteries is an advantage. In an even more preferred embodiment, the battery compartment could house batteries which are electrically connected to one or more of the devices, thereby lowering weight on outer regions of the weapon, either distally on the barrel or laterally on the side rails of the forearm. In other words, by taking battery weight out of the forward mounted auxiliaries, and moving it into a more central region of the firearm system, stability is increased and performance is enhanced. FIG. 12 shows diagrammatically a battery storage region with the grip. In addition, storage regions can also be located anywhere within the grip, including the flat sides that extend rearward along the sides of the magazine well. Such a region would be an ideal location for a flat user interface, such as a touch sensitive LCD display, or IC chipset.

Alternatively, other functionalities could be housed within the grip, such as auxiliary electrical equipment like wiring relays, sensors, accelerometers, gyroscopes, lasers, microprocessors, other integrated circuitry or other electrical or electronic control circuitry, switches, or other electronic features, separate or together with power source storage. For example, the battery pack could be carried on the soldier, with wiring harnesses and relays and controls all housed within the grip to control functionality of the various components on the weapon system. Another functionality, apart from electronics, could be an integrated magazine release lever, or other mechanical integrations such as ambidextrous safety, etc.

Figure 13:
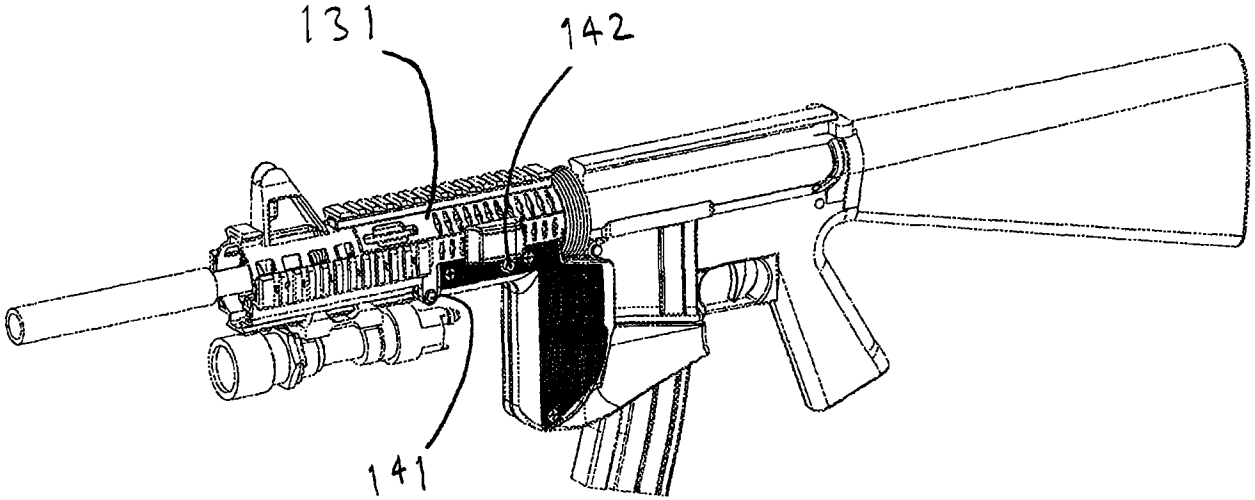
FIG. 13 illustrates an embodiment of the present invention wherein the grip is integral with a handguard/forend rail system.

FIG. 13 illustrates an additional embodiment of the invention wherein the grip is integrated with the handguard/forend/front rail 131. FIG. 13 shows an embodiment where the forend/handguard portion is mounted to the rifle in a generally conventional manner, using the front ring. An alternate embodiment would be where the entire unit is mounted to the weapon at the rear, breach area of the barrel (such as near the delta ring), and does not come in contact with the barrel at any other location. Such a configuration is called a "free float" design.

Figure 14:
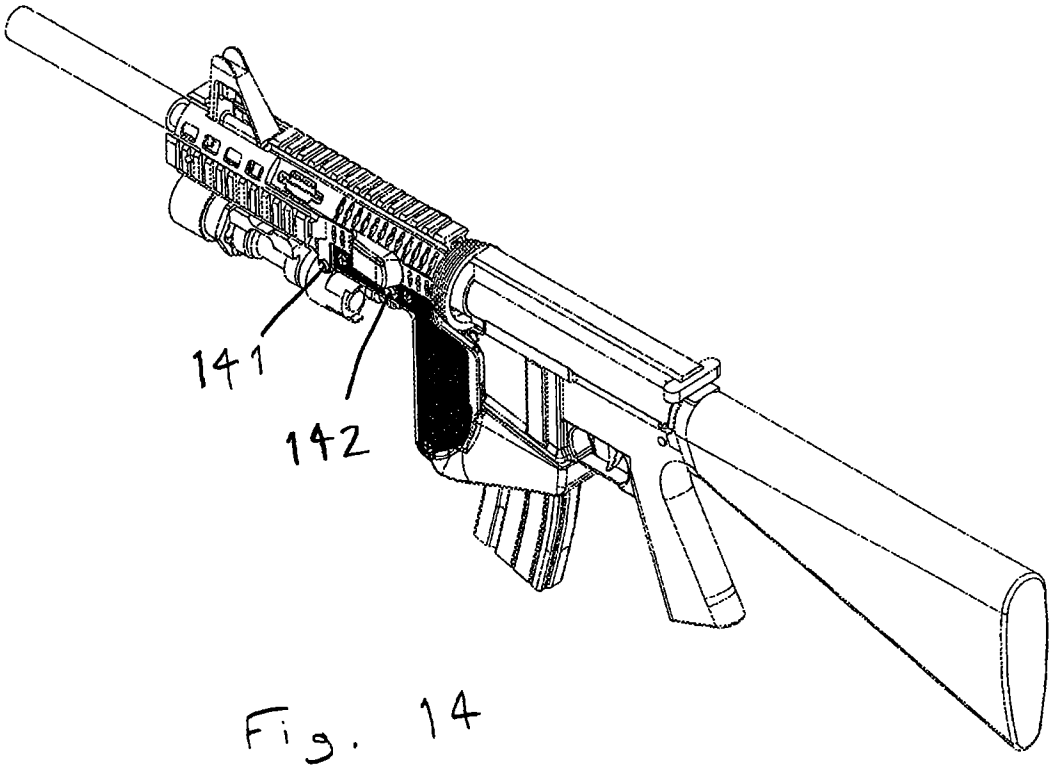
FIG. 14 shows an alternative view of that shown in FIG. 13.

It is noted that a preferred embodiment would provide battery, electronics, switches, sensors or other storage enclosed within the grip. In the case of using this space for battery storage, the batteries would provide power to a flashlight, laser, sighting system or other electronics mounted to the integrated grip and handguard, or other areas of the weapon. FIG. 14 illustrates an alternative view of that which is shown in FIG. 13.

As can be seen in FIGS. 13 and 14, two retention pins 141 and 142 are present. Forward retention pin 141 attaches the grip portion or magazine well extension portion to the forend rail system at a pivot point, much like that described above with respect to FIGS. 5 and 6. With complete removal of both the rearward and forward retention pins 141 and 142, the grip portion (or magazine well extension portion) of the integrated grip and handguard can be completely removed. For normal rifle maintenance, however, such as clearing the bolt group from the upper receiver, the grip portion merely needs to be swung away from the magazine well to allow opening of the upper upon removal of the rear receiver pin of the rifle.

Figure 15:
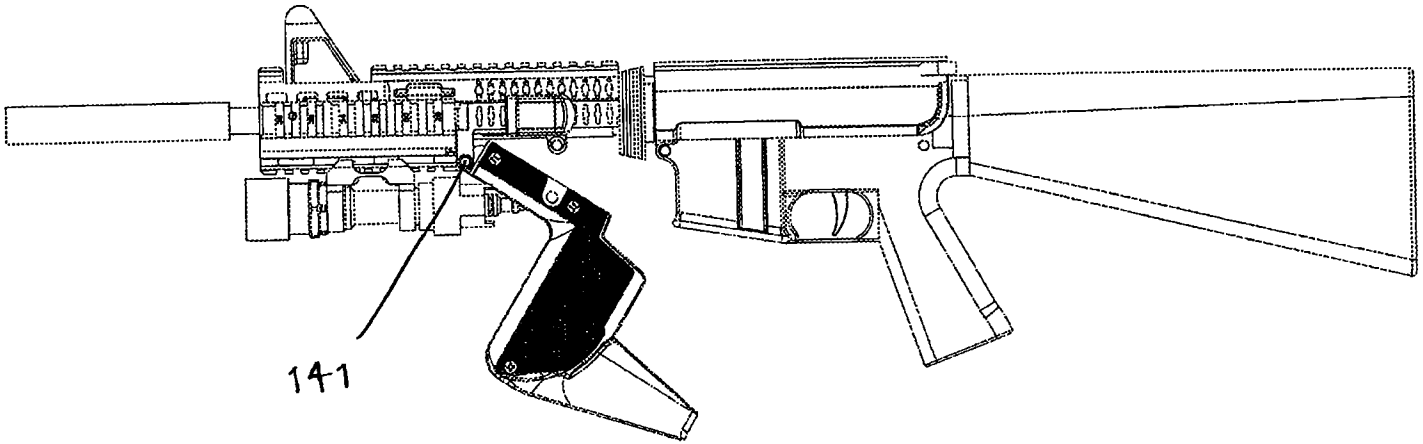
FIG. 15 shows a side view of the integrated handguard/forend rail system installed on a rifle and having a flashlight attached to the bottom rail, with the grip portion pivoted to a disassembly position to allow the separation of the rifle's upper and lower for bolt access.
Figure 20:
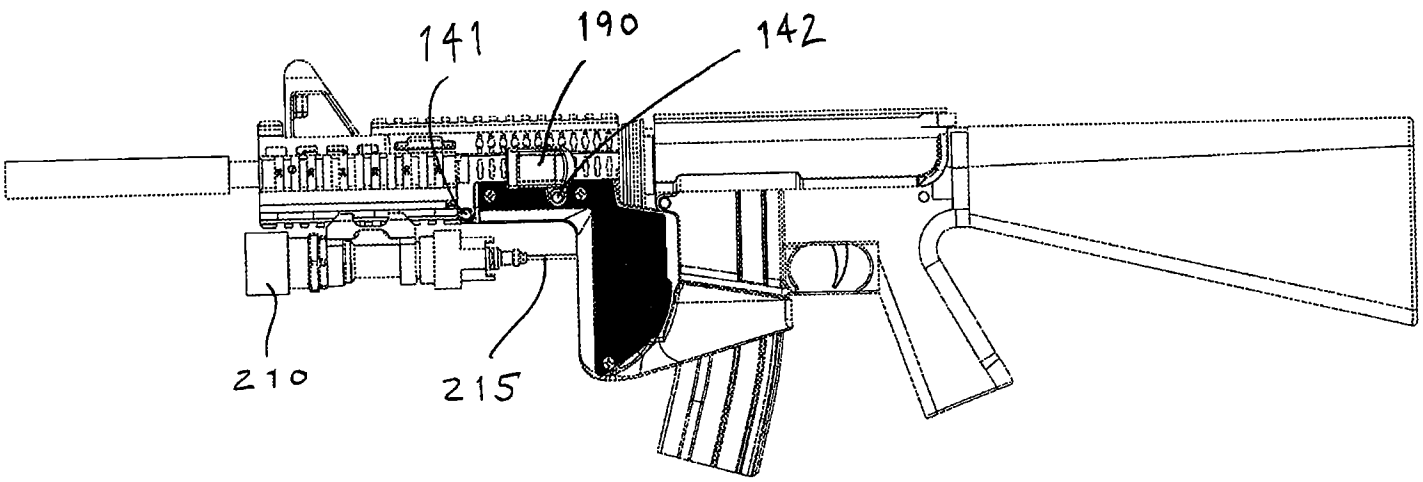
FIG. 20 illustrates an embodiment of the invention mounted to a firearm and having a flashlight mounted to the forend along with a wire running back to the grip portion.

FIG. 15 shows the grip portion pivoted away from the magazine well, in accordance with the above. Note that the flashlight is still mounted to the rail on the bottom of the forend/handguard and remains functional in that any power or control wire still runs back to a switch the same as when the grip portion is in its upward or closed position. It is noted that the wiring need not be removed or altered in any way for the grip portion to be rotated throughout is full range of motion. The switch, the termination at the light, and all points in between are unaffected by, and do not interfere with, the full angular rotation of the grip portion/magazine well extension. FIG. 20 shows the same rig (of FIG. 15) but with the grip in its closed position with pin 142 in place.

Another advantage to the embodiment shown here is that all wiring between the batteries and auxiliary electronic components and microprocessor(s) can be routed internally through the forend/handguard to directly join the components to the power source. Similarly, the control wires can be run internally between the components and the switches (for example as noted below with respect to the thumb rest 190). This internal wiring feature cuts down on the snag potential which exists where wires are run externally. This wire routing can also go through the top rail component and in a similar manner be kept completely out of the way in terms of the external surfaces of the weapon system.

Figure 16:
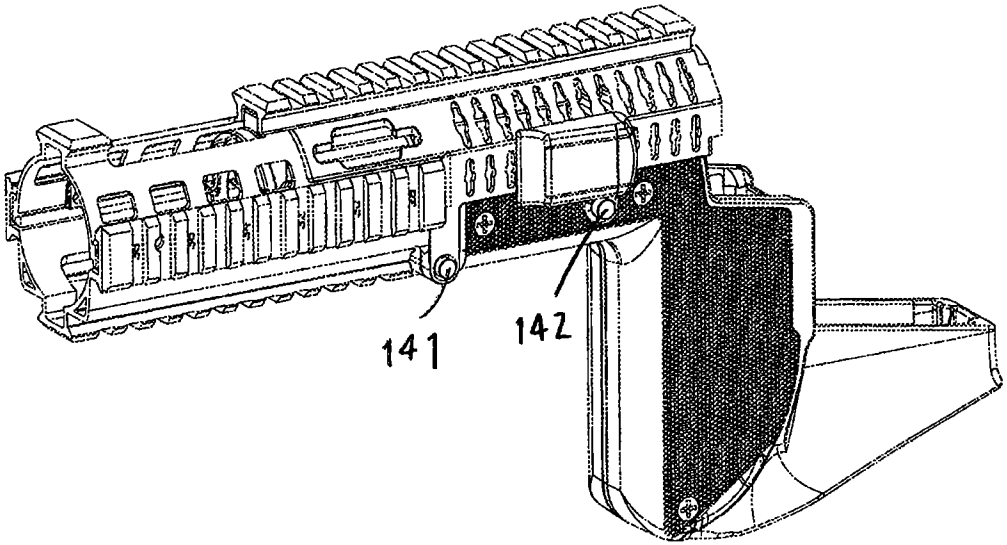
FIG. 16 illustrates an embodiment of the integrated handguard/forend rail system.
Figure 17:
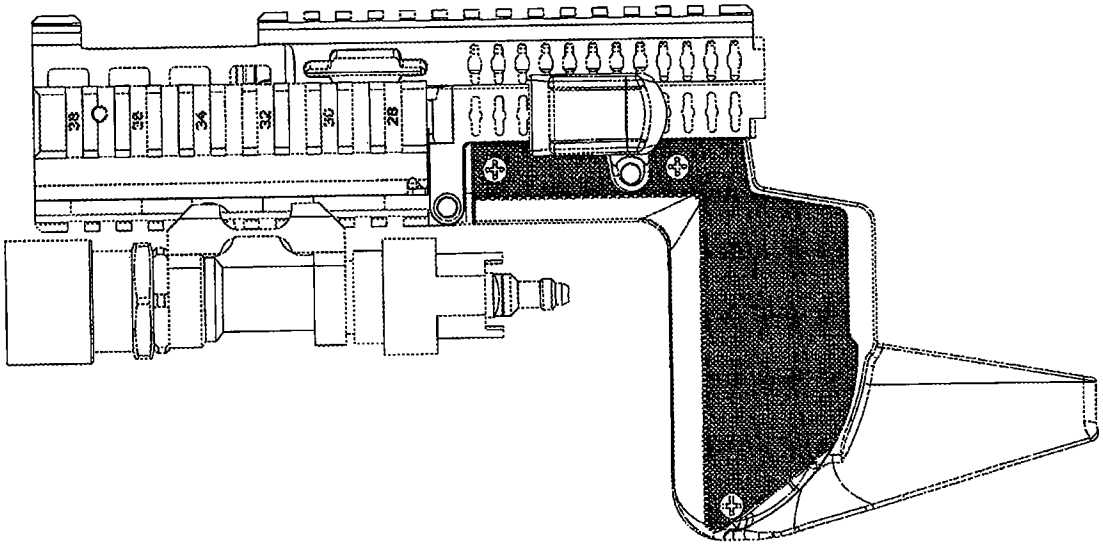
FIG. 17 illustrates that which is shown in FIG. 16 with a flashlight attached to the bottom rail.
Figure 18:
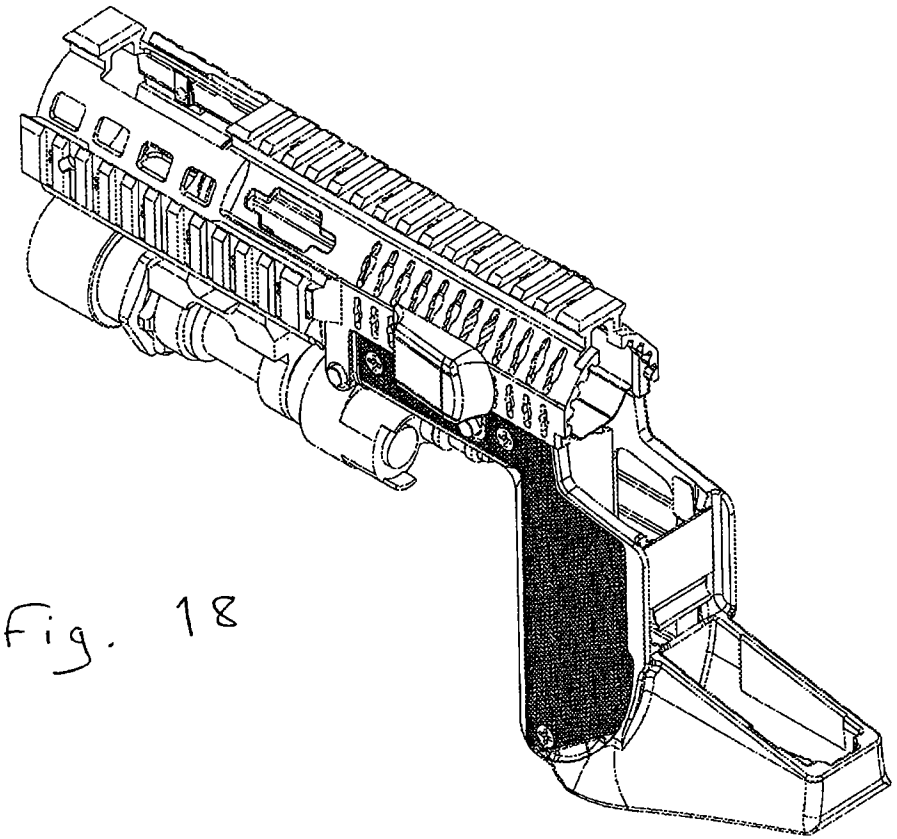
FIG. 18 illustrates an alternative view of that shown in FIG. 17.

FIGS. 16-18 illustrate the integrated grip and handguard/forend disassociated from a rifle, with FIGS. 17 and 18 including a mounted flashlight.

Figure 19:
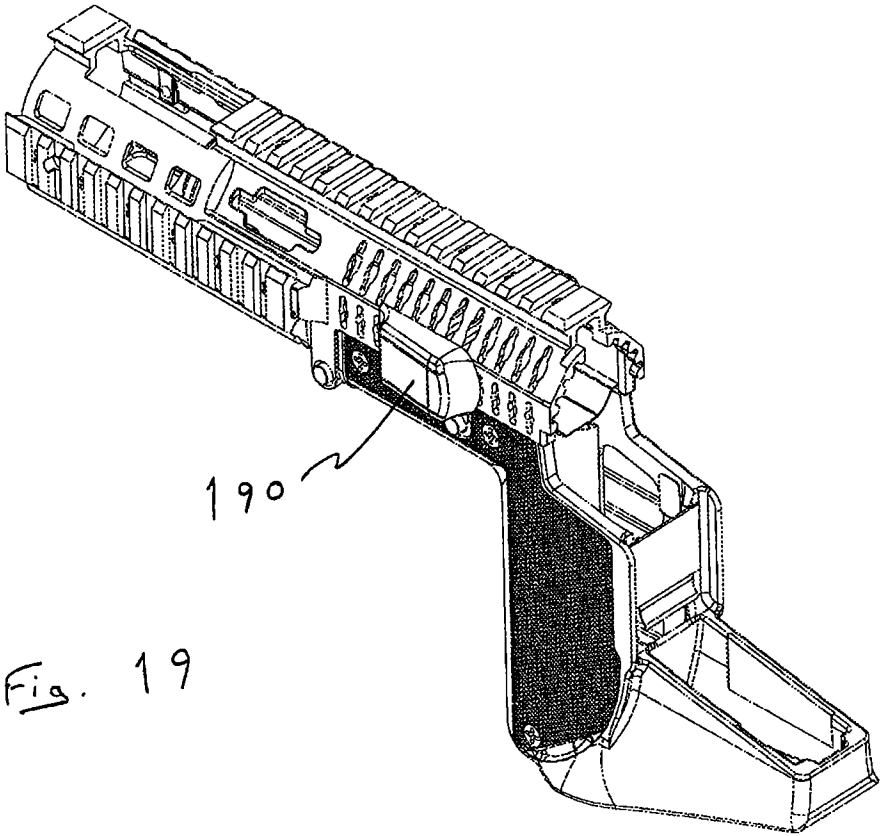
FIG. 19 illustrates an embodiment having a thumb rest on the integrated handguard/forend rail system.

FIGS. 19 and 20 show an additional embodiment of the integrated grip and handguard/forend. In this embodiment, a thumb rest 190 is present on the left side of the handguard/forend, just distal from the delta ring (on an AR-15/M4 style weapon) when the unit is attached to a rifle. As can be seen, it is also disposed generally above the front face of the grip portion.

The thumb rest provides an ergonomic place for the shooter's thumb. The angle of the plane of the thumb rest is more parallel with the cross-section of the bore than perpendicular to it (i.e., the proximal face of the thumb rest is generally perpendicular to the axis of the barrel). When the shooter grasps the weapon, no force at all need or should be exerted by the thumb to maintain a secure hold. In fact, with the orientation described above and as shown in FIGS. 19 and 20, the thumb rest does not encourage a forward force by the user's thumb. Thus, it acts more as a guide to the shooter on where his thumb should be placed and positioned and used to control auxiliary electronic devices. As such, a button or pressure sensitive control panel on the thumb rest would necessarily require that no forward pressure be exerted by the user's thumb, except for operation of the auxiliary device(s). FIG. 20 illustrates thumb rest 190 which has a switch to operate flashlight 210 which is mounted to the forend. FIG. 20 illustrates wire 215 which could be either or both of power and control (on/off).

In a preferred embodiment of this aspect of the invention, the thumb rest also provides for the integration of a thumb activated switch for electronic and electrical devices attached to the weapon, such as the weapon light or laser sight. The orientation, location, and size of the thumb rest provide for a very ergonomic thumb switch. A pressure activated switch of the correct size would fit in the thumb rest and the orientation and positioning of both the rest and the switch would allow for easy and anatomically correct thumb movement to activate the switch. In one embodiment, the switch need not reside directly at the location where the thumb rests, but can be positioned slightly away from this location. In addition it can be angled slightly downward and inward for better thumb ergonomics.

Still another aspect of the grip, other than the power related attributes already discussed, pertains to barrel information, and in particular aggregate shots fired and temperature. In terms of shots fired, it is desirable to count the total shots fired through the barrel to gauge barrel replacement life. The grip, with power management and electronic integration, is a good location to house the necessary instrumentation to achieve this purpose. One embodiment would include a piezo-electronic device embedded in the chamber of the barrel, facing downward into the grip. A sensor from the grip, or power from the grip, would be connected to this device through proximity or contact as the grip is swung up, or otherwise placed, into position. Such a device could be connected to electronics in the grip so that each shot would register and be counted for barrel life. In one embodiment, the counting electronics and battery would reside entirely in the grip. Alternatively there could be redundant systems in the grip and barrel that communicate so that when the grip is removed the count is not lost. The grip would function to collect the information and display it to the user. Another way to do this would be to have a motion sensor on the piston rod. Every time it moves faster than a threshold velocity, a shot is counted. This would likely not be as reliable a count as the piezo method, but it would be much simpler and cheaper.

Also, at the same location of the piezo could be a temperature gauge. Such information would be useful in that the shooter could switch to open bolt firing should the chamber get so hot as to risk cook-off. Or, if an electronic actuator is used to control the mechanism to switch between open and closed bolt, the electronics could make the switch automatically if a threshold temperature is reached. Such a mechanism would be particularly practical in weapon systems such as a squad automatic weapon (SAW).

Another feature would include instrumentation to determine the remaining rounds in the magazine. Where the grip essentially comes in contact with the magazine, or comes in very close proximity to the magazine, in the area where the magazine well butts up against the magazine well of the lower receiver, specific techniques are envisioned as a part of the present invention to monitor cartridge count. Information about remaining round count in the magazine can be transferred to the grip electronics in this area—assuming that the round count mechanism is self-contained within the magazine.

Alternatively, the magazine does not need to have a self-contained mechanism—some of it can be driven by the grip electronics. Power can come from the grip system. For example, the magazine could have a variable resistor that runs the full length of travel of the floor plate. The floor plate itself is part of the resistor and electrical system, and it completes the electrical circuit. As it moves upward, the current loop shortens and the electricity travels through less resistance, giving a different current reading to the grip electronics, which is used to determine remaining round count.

There can be other ways to use the magazine floor plate in conjunction with other parts of the system being included in the grip. For example, the floor plate can have a position device on it that could be read by the grip system. As it moves, the grip collects a different reading and translates that to round count. Such a system could include a radio frequency, a magnetic reading from the magazine floor plate, or various other position location technologies. The grip could then display the remaining round count to the shooter in numerous ways. One way could be a numerical display. Another could be an audio warning.

The grip is preferably in close proximity to the trigger area of the weapon to provide a conduit to power switches located in proximity of the shooting hand. For example, the pistol grip can have a pressure switch mounted on it with the electrical connections routed along the pistol grip to the underside of the trigger guard, and ending at the forward position of the trigger guard. When the grip is moved into its firing position, electrical contact between the two devices can be achieved, enabling the pressure switch on the pistol grip to activate any component to which the grip power system is connected. The switch at the pistol grip area can be of any type, and is not limited to the pressure variety. In still another embodiment, the shooting hand grip "pistol grip" can be a fixed part of the flared funnel. In such a case, the front and rear grip and funnel are all one component that swing away together.

Similarly, the grip is preferably in close proximity to the top portion of the upper receiver, where the sighting system is typically located. Using a similar connection means as described with the pistol grip, the grip can integrate the sighting system into the grip power management and distribution system. A similar methodology can be used in terms of integrating any device into the power management and distribution system of the grip.

One embodiment consistent with that discussed above would involve the "painting" of a target on the battlefield through the use of a smart weapon system. The integration of several rifles, each equipped with a GPS, laser rangefinder, and gyroscope and/or compass would allow for intelligence to be gathered on the battlefield and fed back to a computer. This concept includes the networking of several rifles within a group of war fighters, or even all rifles within a platoon. The GPS allows for the determination of the location of the rifle, the gyroscope for the direction in which the rifle is pointed, and the laser rangefinder for the determination of the distance to the target. This information can be used and fed back to a computer for integration with another data set from at least one other war fighter for the painting of a target. All of the power and information management systems needed for this could be housed within the grip handle in accordance with the above.

Finally, FIG. 21 illustrates an embodiment of the invention in an exploded view surrounding an M-16 style rifle. As can be seen, an upper rail component 220 can be provided to mate with the lower rail component 230. Opening 240 is disposed within upper rail component 220 to allow for placement over a standard front site 250. FIG. 20 shows the grip and rail assembly in place on the rifle (with the addition of a flashlight mounted on the lower rail, which flashlight is not shown in FIG. 21). FIG. 21 also shows the gas tube 260 and the delta ring 261. Upper and lower heat shields 270 and 271 are also shown and are an optional part of this embodiment of the present invention.

Although the present invention has been particularly described in conjunction with specific preferred embodiments, it is evident that many alternatives, modifications, and variations will be apparent to those skilled in the art. It is therefore contemplated that the appended claims will embrace any such alternatives, modifications, and variations as falling within the true scope and spirit of the present invention.

What is claimed:

1. A firearm grip for a firearm having a lower receiver, an upper receiver, a forend extending from the upper receiver, and a forward magazine well, the upper and lower receivers attached to each other in a closed position by a front pin and a rear pin, and pivotably moveable with respect to each other at the front pin when the rear pin is withdrawn;

the grip comprising:

a grip portion configured to extend downward from the firearm forend;

an attachment portion adapted to attach the grip to the firearm in two positions, a first position such that the grip portion is immediately forward of the magazine well when the upper and lower receivers are in the closed position, and a second position such that the grip does not interfere with the pivoting of the upper and lower receivers when the rear pin is withdrawn; and a magazine well extension portion extending rearward from the grip portion to at least partially surround the magazine well of the firearm when the grip is in its first position.

2. The firearm grip of claim 1 wherein the magazine well extension portion has at least two angled feed ramps.

3. The firearm grip of claim 1, the grip portion defining a chamber to house at least one electronic component.

4. A firearm grip for a firearm having an upper receiver component having a forend, and a lower receiver component having a forward magazine well, the upper receiver component and lower receiver component attached to each other in a closed position by a front pin and a rear pin, and pivotably moveable with respect to each other at the front pin when the rear pin is withdrawn;

the grip comprising: a grip portion configured to extend downward from the firearm forend; an attachment portion adapted to attach the grip to the firearm in two positions, a first position such that the grip portion is immediately forward of the magazine well, and a second position such that the grip does not interfere with the pivoting of the upper receiver component and lower receiver component when the rear pin is withdrawn; and a magazine well extension portion extending rearward from the grip portion to at least partially surround the magazine well of the firearm when the grip is in its first position.

5. The firearm grip of claim 4, the grip portion defining a chamber to house at least one electronic component.

6. A firearm grip comprising: a forend; a grip portion connected to the forend and moveable between a first attached position and a second attached position with respect to the forend to which it is connected; the grip portion including angled feed ramps to aid in magazine insertion, and a front hollow wall accessible for the storage of auxiliary electronic devices.

7. The grip of claim 6 wherein the forearm is a rail system for a weapon having a weapon upper, a weapon lower, and a forward magazine well, the weapon upper and weapon lower engageable in a pivoting relationship.

8. The grip of claim 6 wherein the angled feed ramps include a front angled feed ramp, a rear angled feed ramp, and two side angled feed ramps, and the dimensions of at least two of the angled feed ramps are different.

9. A grip for a firearm having a firearm upper, a firearm lower, and a forward magazine well, the firearm upper and firearm lower engageable in a pivoting relationship, the grip comprising: a magazine portion adapted to extend generally downward along at least a part of the front of the magazine well so as to prevent the insertion of any part of the hand of the user between the grip and the front of the magazine well; the magazine portion moveable between a firing position and an open position, the open position allowing for movement between the weapon upper and weapon lower during partial or complete disassembly of the weapon.

10. The grip of claim 9 further comprising a forearm attached to the magazine portion.

11. The grip of claim 9 further comprising a forearm attached to the magazine portion, the forearm comprising a rail system adapted to allow the mounting of auxiliary equipment to the grip.

12. The grip of claim 9 wherein the magazine portion further comprises a rear grip portion which extends around the back of the magazine well to form at least one angled feed ramp surface to aide in magazine insertion into the magazine well.

13. The grip of claim 9 wherein the magazine portion further comprises a rear grip portion which extends around the back of the magazine well to form a front angled feed ramp, a rear angled feed ramp, and two side angled feed ramps.

14. The grip of claim 9 wherein the magazine portion further comprises a rear grip portion which extends around the back of the magazine well to form a front angled feed ramp, a rear angled feed ramp, and two side angled feed ramps, and the dimensions of at least two of the angled feed ramps are different.

15. A grip for a firearm having a forward magazine well configuration, the grip comprising: a forearm; a rear portion configured to extend generally downward along at least a part of the front of the magazine well when the grip is attached to the firearm, the rear portion forming a storage cavity in front of the magazine well and angled feed ramps to aid in magazine insertion into the magazine well when the grip is attached to the firearm.

16. The grip of claim 15, wherein the feed ramps do not all have the same dimensions.

17. A firearm having an upper, a lower, a forward magazine well, and a grip, comprising: a portion of the grip extending generally downward along at least a part of the front of the magazine well so as to prevent the insertion of any part of the hand of the user between the grip and the front of the magazine well, the grip configured so as to not interfere with the pivoting relationship between the upper and lower during partial or complete disassembly of the firearm.

18. The firearm of claim 17, wherein the grip is adapted to mechanically couple to the firearm in a first position compatible with a firing position, and to move to a second position compatible with pivoting the upper and lower to a non-firing position.

19. The grip of claim 9, further comprising a chamber in the grip to house at least one electronic component.

20. The firearm of claim 17, further comprising a chamber in the grip to house at least one electronic component.

* * * * *

UNITED STATES PATENT AND TRADEMARK OFFICE

CERTIFICATE OF CORRECTION

PATENT NO. : 8,590,201 B2
APPLICATION NO. : 13/054822
DATED : November 26, 2013
INVENTOR(S) : John Brixius It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 394 days.

Signed and Sealed this
Twenty-second Day of September, 2015

Michelle K. Lee

Michelle K. Lee
*Director of the United States Patent and Trademark Office*